United States Patent [19]

Pensa

[11] 4,077,744

[45] Mar. 7, 1978

[54] CONTROL SYSTEMS FOR VARIABLE CAPACITY HYDRAULIC MACHINES

[75] Inventor: Carlo Pensa, Como, Italy

[73] Assignee: Massey-Ferguson Services N.V., Curacao, Netherlands Antilles

[21] Appl. No.: 632,413

[22] Filed: Nov. 17, 1975

[30] Foreign Application Priority Data

Nov. 18, 1974 United Kingdom ..... 49874/74

[51] Int. Cl.[2] ..... F04B 1/26; F01B 13/04

[52] U.S. Cl. ..... 417/218; 91/506

[58] Field of Search ..... 92/12.2; 91/505, 506; 417/212, 218, 222

[56] References Cited

U.S. PATENT DOCUMENTS

| | | | |
|---|---|---|---|
| 2,945,449 | 7/1960 | Le Fabvre et al. | 91/506 |
| 2,971,498 | 2/1961 | Bloch | 417/222 |
| 3,232,238 | 1/1966 | Faisandier | 417/212 |
| 3,407,738 | 10/1968 | Bosch | 417/218 |
| 3,588,286 | 6/1971 | Skinner | 91/506 |
| 3,635,021 | 1/1972 | McMillen | 417/222 |
| 3,669,570 | 6/1972 | Himmler | 91/506 |
| 3,694,108 | 9/1972 | Pensa | 417/222 |
| 3,861,832 | 1/1975 | Pinson | 417/212 |

FOREIGN PATENT DOCUMENTS

| | | | |
|---|---|---|---|
| 1,126,873 | 9/1968 | United Kingdom | 417/222 |

*Primary Examiner*—William L. Freeh
*Attorney, Agent, or Firm*—Thomas P. Lewandowski

[57] ABSTRACT

A pump is provided with a regulating device which includes a valve and a motor. The motor operates on the pump to vary the capacity thereof. Movement of the motor is controlled by the valve which has a spool and a body. A feedback link is provided between the motor and the body so that movement of the motor due to a displacement of the spool moves the body to return the valve to neutral. Hunting of the transmission is thus reduced.

3 Claims, 3 Drawing Figures

CONTROL SYSTEMS FOR VARIABLE CAPACITY HYDRAULIC MACHINES

This invention relates to hydrostatic transmission and more particularly to regulators and controls for use with such transmissions.

A hydrostatic transmission usually comprises a variable capacity pump and a fixed or variable capacity motor interconnected by fluid conduits. The pump is rotated by a prime mover and transmits energy through fluid conveyed by the conduits to the motor. The power absorbed by the transmission is the product of the rate of flow of the fluid from the pump and the pressure of the fluid delivered by the pump.

The flow rate is determined principally by the capacity of pump, i.e. the volume of fluid displaced per revolution of the pump, and the pressure is determined principally by the load imposed on the motor.

It is possible that a condition of the transmission may be chosen which results in a dangerous overload of the transmission or prime mover. It is therefore desirable that a regulating device be provided which controls the transmission in accordance with a predetermined parameter for example the power consumption or the torque imposed on the motor.

Such devices are known.

However a problem with hydrostatic transmissions using a regulator and particularly those used in mobile equipment is that the conditions imposed on the transmission change rapidly so that before the regulator has operated upon the transmission a different condition prevails causing a different signal to be fed to it. This tends to cause hunting of the transmission which results in jerky operation of the transmission and discomfort for the operator.

It is an object of the present invention to provide a control device for a transmission in which the above disadvantages are obviated or mitigated.

According to the present invention there is provided a control device for a hydraulic machine having an adjusting member to vary the capacity thereof, said control device including regulator means operable to control said machine in accordance with a predetermined parameter and valve means for controlling a hydraulic motor connected to said adjusting member, said valve means comprising a spool movable within a body in response to changes in said parameter, and operable to cause movement of said motor, said control device having link means movable with said adjusting member and connected to said valve so as to move said valve upon movement of said adjusting member to prevent further movement of said motor.

According also to the present invention there is provided apparatus comprising at least one fluid machine which has a fluid pressure conduit connected thereto, adjusting means to vary the fluid flow through the machine regulator means operable upon said adjusting means to maintain the power consumption of said machine below a predetermined level, said regulator means including motor means connected to said adjusting means, valve means operable to control said motor means, variable transmission means operable on said valve means and including a member movable conjointly with said adjusting means to vary the ratio thereof in unison with the volume displacement of said machine and pressure signalling means responsive to pressure in said conduit and operable through said transmission means to move said valve means by an amount proportional to the product of the force received from said pressure signalling means and the volume displacement of the machine the movement of said valve means beyond a predetermined position, corresponding to the said predetermined maximum level, being operative to energise said motor means to cause said adjusting means to reduce the volume displacement of said machine, said regulator including link means movable with said motor and connected to said valve so as to move said valve upon movement of said motor to prevent further movement thereof.

An embodiment of the invention will now be described by way of example only with reference to the accompanying drawings in which FIG. 1 is a diagramatic representation of a variable capacity pump and a regulator.

Figure 1:
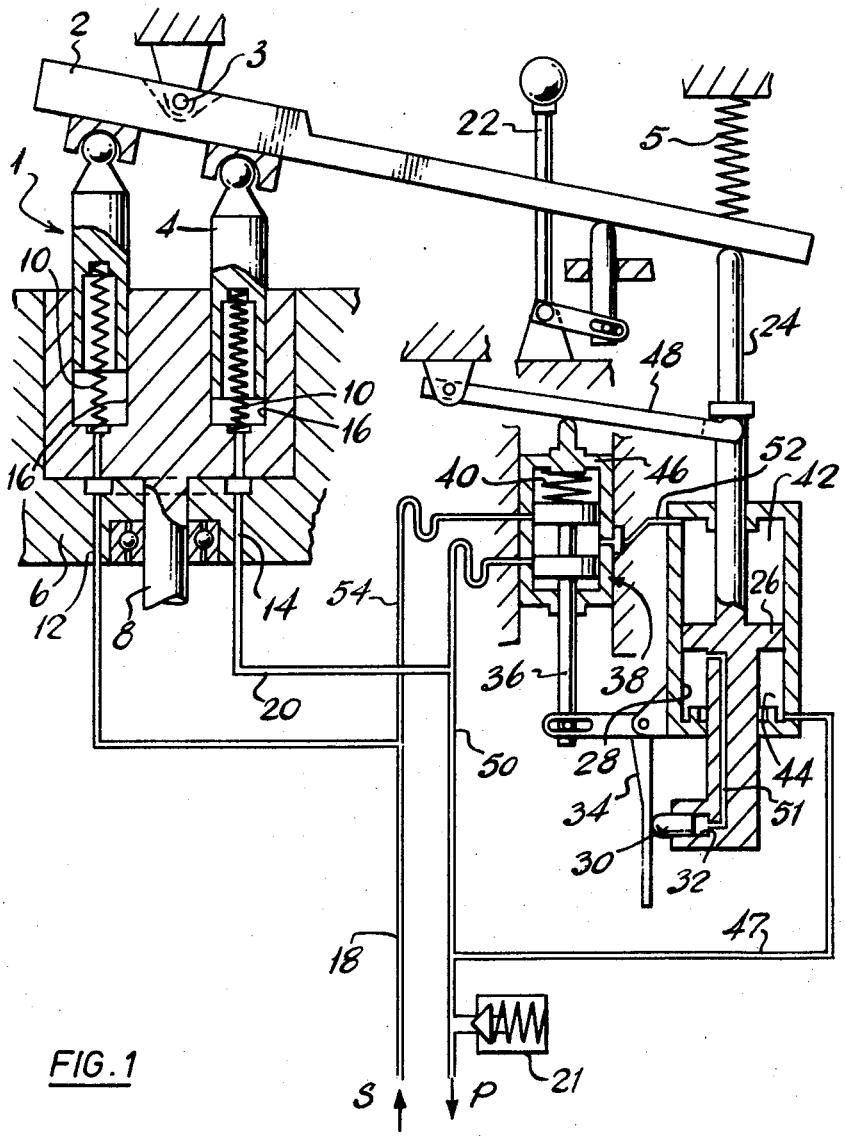

Referring now to FIG. 1, a pump 1 is provided with a swashplate 2 for varying the stroke of plungers 4. The swashplate is fulcrumed as at 3 and biased toward the maximum stroke position by a spring 5. The barrel 6 of the pump 1 and the plungers 4 are rotated by a shaft 8 connected to a prime mover (not shown) thus causing the plungers 4 to reciprocate in the barrel 6. Springs 10 ensure that the plungers 4 follow the swashplate 2. An inlet port 12 and outlet port 14 permit flow to and from bores 16 in which the plungers 4 slide. The inlet port 12 allows fluid to flow into the bores 16 from a suction conduit 18 as the plunger 4 is moving along the bore 16 under the action of the spring 10. As the direction of the plunger 4 is reversed, by virtue of the rotation of the barrel 6, the bore 16 is connected to the outlet port 14 and fluid is expelled into the pressure conduit 20, the maximum pressure therein being governed by a relief valve 21. The inclination of the swashplate 2 may be adjusted by a manual control, shown diagramatically at 22 to give increased piston stroke and consequently increased fluid displacement.

The swashplate 2 is also acted on by a piston rod 24 connected to a piston 26 which slides within a fixed cylinder 28. The piston rod 24 extends through both end walls of the cylinder 28 and carries a piston 30 mounted within a cavity 32. The piston 30 bears against one arm of a bellcrank 34 which is fulcrumed to the cylinder 28. The other arm of the bellcrank 34 operates a spool 36 slidably mounted within the body 46 of a valve 38 which controls flow to or from the cylinder 28. Movement of the bellcrank 34 by the piston 30 is opposed by a spring 40 which is mounted between the body 46 and the spool 36. The body 46 is slidably mounted and bears against a lever 48 which is pivotable about a pin 49 and co-operates with a shoulder 56 formed on the piston rod 24.

The piston 26 divides the cylinder into two chambers 42, 44. The chamber 44 is supplied with fluid by way of conduit 47 which is connected to the pressure conduit 20. A duct 51 formed in the piston rod 24 conveys fluid from the chamber 44 to the cavity 32. Thus the piston 30 is subjected to the same fluid pressure as exists in the pressure conduit 20.

Pressure fluid is supplied by way of conduit 50 to the control valve 38 which controls flow to or from the chamber 42 through conduit 52, and exhausted fluid is taken from the valve 38 to the suction conduit 18 by a conduit 54.

Figure 2:
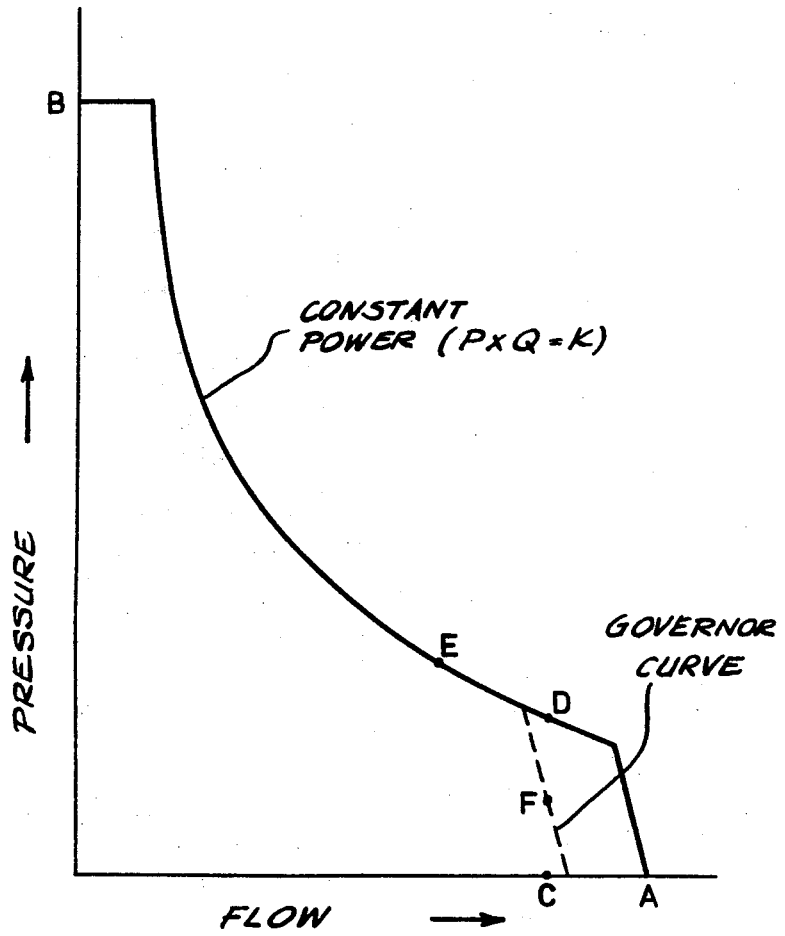
FIG. 2 is a graph of pressure versus flow showing a constant horsepower curve.

The operation of the device will now be described. The graph of FIG. 2 is a plot of pressure versus flow rate for a constant power rating. The ordinate A represents the maximum flow rate available from the pump. The ordinate B represents the maximum system pressure as set by the relief valve 21. The ordinate C represents the flow rate of the pump as set by the manual control 24. In the position shown in FIG. 1 the power absorbed by the pump matches the power delivered by the prime mover and is denoted by the point D on the graph. The pressure delivered by the pump to the conduit 20 is transmitted to the cavity 32 and urges the piston 32 against the spring 40. The position of the piston 32 along the bellcrank 34 is proportional to the flow rate of the pump, as determined by the swashplate position, and so the moment acting on the bellcrank is proportional to the product of the pressure and the flow rate, i.e. the power delivered to the pump. The spring 40 exerts a force sufficient to balance the moment exerted by the piston 30 at the maximum power rating. Thus the valve 38 remains in a neutral condition and fluid is locked in the chamber 42 so preventing movement of the piston 26 under the influence of pressure in the chamber 44.

If the pressure in the conduit 20 now increases, the force exerted by the piston 30 overcomes the spring 40 and causes the bellcrank 34 to rotate clockwise about its pivot, moving the spool 36 upwards. The conduit 52 is thus connected to the conduit 54 and fluid flows from the chamber 42 allowing the piston 26 to move upwards and decrease the flow of the pump.

Since the piston 30 moves with the piston rod 24, the lever 48 pivots about the pin 49 and allows the body 46 to move under the force exerted by the spring 40 so returning the valve 38 to a neutral condition and preventing further flow from the chamber 42.

The moment exerted by the piston 30 is decreased and the spring 40 balances the spool 36 in a neutral position against the force of the piston 30. This condition is represented by the point E on the curve. If the pressure now drops, the spring 40 forces the piston 30 into the cavity 32 and moves the spool 36 downwards, thus connecting the conduit 50 with the conduit 52. Fluid flows into the chamber 42 at an equal pressure to that in chamber 44. The side of the piston 26 facing the chamber 42 has a greater surface area than that facing the chamber 44 by virtue of the differing diameter of the piston rod 24 on each side of the piston 26. The net force acting on the piston 26 causes it to move downwards expelling fluid from the chamber 44 and increasing the flow rate of the pump 1. The lever 48 is moved with the piston rod 24 and moves the body 46 to prevent flow through the line 52. The moment exerted by the piston 30 increases and balances the bellcrank 34 against the spring 40 to hold the spool 36 in neutral.

The manual control 22 determines the maximum flow rate of the pump. If the power absorbed by the pump is below the maximum level, then the regulator will act to increase the flow rate of the pump. The manual control however prevents the swashplate increasing the pump displacement and so the prime mover is not loaded to its maximum power output as shown by point F on the graph. If the prime mover is a diesel engine then the speed will increase to the rated speed and the fuel injection apparatus will defuel the engine under the influence of the governor.

Similarly, an electric motor will govern its speed and/or power output to the circumstances prevailing.

Figure 3:
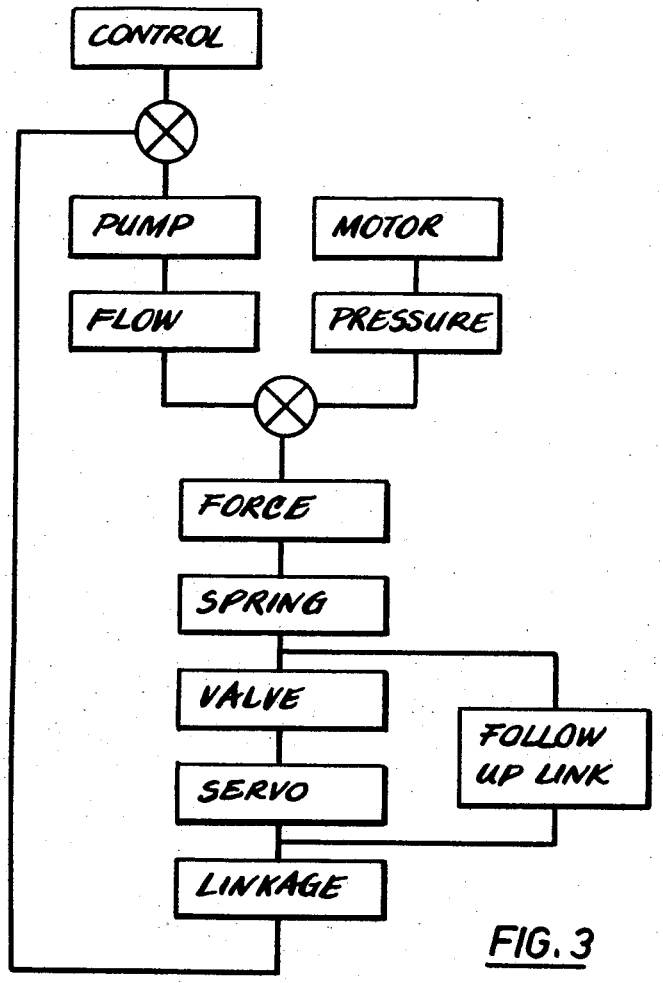
FIG. 3 is a diagramatic representation of the signal path of the pump and regulator.

Thus the regulator acts to maintain the power demand of the pump at or below a predetermined value and, as can be seen in FIG. 3 the length of the signal path is shortened by virtue of the presence feedback means in the form of of the follow link 48. Other mechanism could be used or even a fluid or electrical feedback may be possible with embodiments other than the particular regulator means disclosed so that hunting of the transmission is eliminated.

The signal path for the regulator originates with the manual control 22 which operates on the pump 1 to vary its flow rate. The motor connected to the pump 1 determines the pressure the pump must deliver to move the load connected to the motor.

The pressure is sensed by the piston 30 and the flow rate by the position of the piston along the bellcrank 34 and the bellcrank adds the two signals to produce a force on the spring 40. The spring 40 controls movement of the valve 38 which in turn controls the servo motor 24–30. Upon sensing an overload condition, the valve 38 signals to the servo motor 24–30 which operates through the linkage i.e. the swashplate 2, to vary the flow rate and hence the pressure of fluid delivered by the pump 1 which is signalled back to the valve 38 by the bellcrank 34.

By inserting the follow up link 48, the signal path from the servo through the linkage and bellcrank to the valve is replaced by a direct connection between servo and valve. Thus the response time is reduced. If a more complicated linkage involving servo motors and servo valves is used to control the pump 1 then the effect of the link is still more beneficial.

What we claim is:

1. In a fluid translating device having a fluid pressure conduit connected thereto, adjusting means to vary the fluid flow through the device, regulator means operable upon said adjusting means to maintain the power consumption of said device below a predetermined maximum level, where the regulator means includes motor means connected to the adjusting means, valve means operable to control the motor means, variable transmission means operable on the valve means and including a member movable conjointly with the adjusting means to vary the ratio thereof in response to the volume displacement of the device and pressure signaling means responsive to pressure in the conduit and operable through the transmission means to move the valve means by an amount proportional to the product of the force received from the pressure signaling means and the volume displacement of the device, the improvement comprising: the valve means including a body and spool slideable within said body, said body slideable relative to the device, feedback means movable by the motor means and operable to apply a force on said valve body to move the valve body in response to movement of the motor means, said valve body biased to permit application of the product force in one direction and the feedback means force in the other direction, said feedback means force causing movement of said valve means to offset the correction resulting from application of the product force on said valve means.

2. Apparatus according to claim 1 wherein a spring is housed between said spool and said body and acts to bias said spool and said body apart.

3. Apparatus according to claim 1 wherein said feedback means includes link means interconnecting said motor means and said valve body.

* * * * *